US006460267B1

(12) United States Patent
Cormack

(10) Patent No.: US 6,460,267 B1
(45) Date of Patent: Oct. 8, 2002

(54) DRAWING TEMPLATE FOR PLASMID DNA

(76) Inventor: Robert S. Cormack, 1400 20th St., NW., Apt. 516, Washington, DC (US) 20036-5959

( * ) Notice: Subject to any disclaimer, the term of this patent is extended or adjusted under 35 U.S.C. 154(b) by 0 days.

(21) Appl. No.: 09/411,218

(22) Filed: Oct. 4, 1999

(51) Int. Cl.[7] ..... B43L 13/20
(52) U.S. Cl. ..... 33/565; 33/566
(58) Field of Search ..... 33/565, 562, 563, 33/566

(56) References Cited

U.S. PATENT DOCUMENTS 2,371,485 A * 3/1945 Waldman ..... 33/565
2,579,857 A * 12/1951 Premo ..... 33/565
3,119,188 A * 1/1964 Orndorff ..... 33/565
5,031,333 A * 7/1991 Shelley ..... 33/565

* cited by examiner

*Primary Examiner*—Christopher W. Fulton
(74) *Attorney, Agent, or Firm*—Lalos & Keegan

(57) ABSTRACT

Apparatus is disclosed in which a flat, transparent, plastic template bears a combination of inscribed marks and apertures to cooperate with each other so as to enable a user to readily draw two-dimensional depictions of circular and linear plasmid deoxyribonucleic acid (DNA). The template further cooperates with additional apertures for the forming of indicators and markings commonly incorporated in drawings of plasmid DNA.

12 Claims, 1 Drawing Sheet

DRAWING TEMPLATE FOR PLASMID DNA

CROSS-REFERENCES TO RELATED APPLICATIONS

Figure 1:
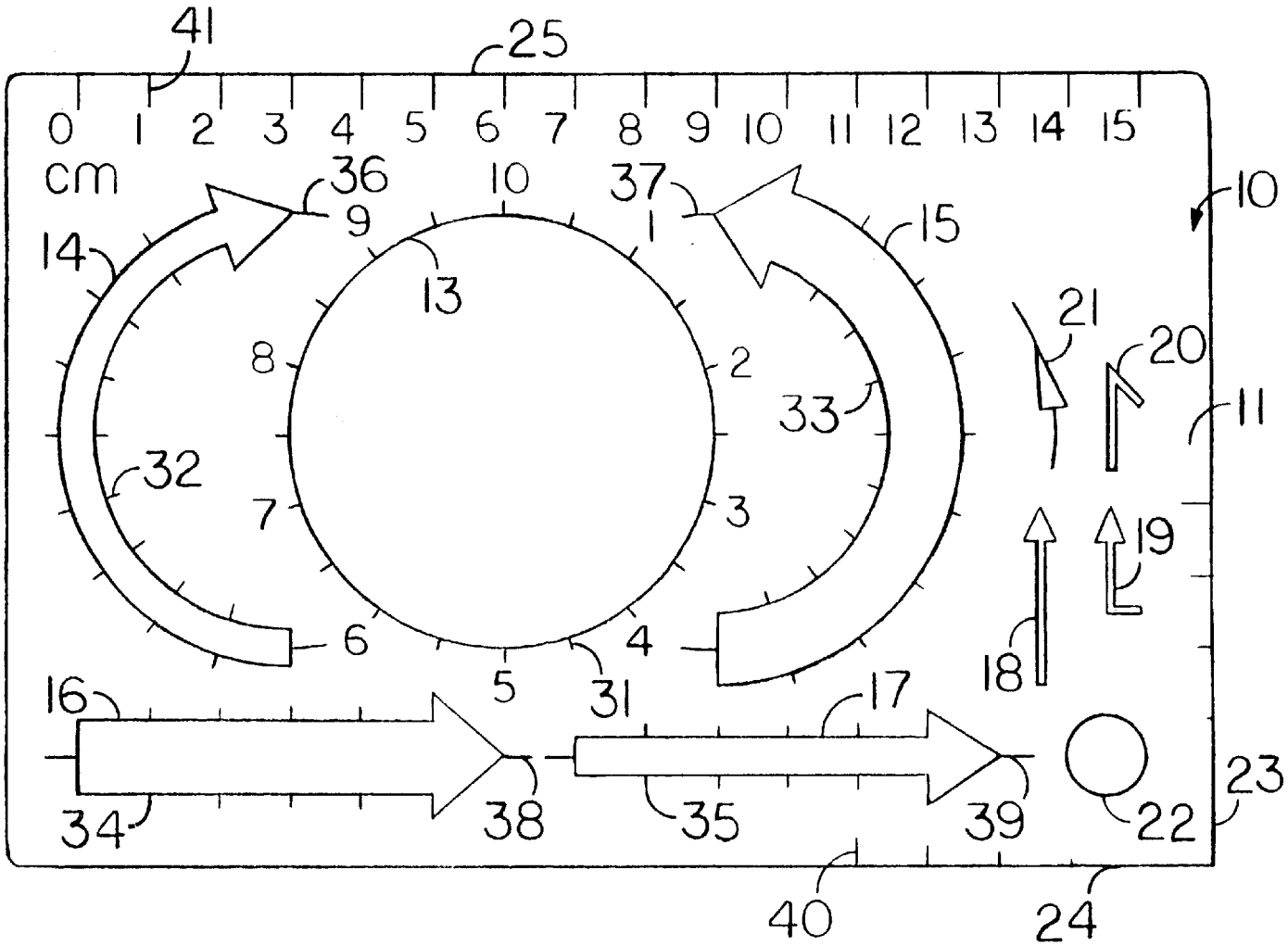

Not applicable.

BACKGROUND—FIELD OF INVENTION

This invention relates to drafting instruments and pertains to templates which assist a scientist in drawing two-dimensional representations of plasmid deoxyribonucleic acid (DNA).

BACKGROUND—DESCRIPTION OF PRIOR ART

Drawings of plasmid DNA are commonly performed by scientists in the field of biochemistry and related disciplines. Depictions of both circular and linear forms of plasmid DNA are usually drawn free hand with the assistance of geometrical templates or compasses. Many separate, time-consuming drawing steps are required to render satisfactory results. Moreover, available hand-held drafting instruments do not provide guides for specific features needed for the drawing of plasmid DNA, such as curved arrows.

Thereafter, inventors created computer-aided drafting software as a means to present plasmid DNA information. However, these software applications are relatively expensive, require considerable amounts of operational instruction, and do not address the need for hand drawing, simplicity, and portability.

Accordingly, one object of this invention is to achieve a device which facilitates the drawing of both circular and linear forms of plasmid DNA in a unitary design which is mechanically simple and easy to use.

SUMMARY

In accordance with the preferred embodiment of the invention, a transparent, plastic template cooperates with indicia marked on its surface to facilitate drawing of a variety of circular and linear plasmid DNA forms.

OBJECTS AND ADVANTAGES

Accordingly, an object of the present invention is to provide a simple template for forming curved arrows, curved bars, straight arrows, and straight bars and for describing circles and straight lines to facilitate the construction of plasmid DNA drawings.

Further objects and advantages are to provide a plasmid DNA drawing template that can be quickly and conveniently used without the need for free hand or computer-aided drafting. Still further objects, advantages, and salient features will become more apparent from a consideration of the ensuing description and drawing.

DRAWING FIGURES

FIG. 1 is a front elevation view of the overall structure of the invention.

DESCRIPTION

FIG. 1—Preferred Embodiment

Referring to FIG. 1, a flat plastic, preferably transparent, unitary panel 10 is disclosed which comprises a template 11 and a plurality of openings defined by edges 13, 14, 15, 16, 17, 18, 19, 20, 21, and 22.

In the embodiment disclosed, the edge 13 defines a large circular opening. Moreover, the edge 13 is marked with indicia 31 distributed preferably every 18 degrees.

The edges 14 and 15 define curved arrows whose central radii matches the radius of the large circle defined by the edge 13. The edges 14 and 15 are marked with indicia 32 and 33, respectively, distributed preferably every 18 degrees. Moreover, the edges 14 and 15 are marked with indicia 36 and 37, respectively, at their radial centers.

The edges 16 and 17 define straight arrows whose lateral centers are marked by indicia 38 and 39, respectively. Moreover, the edges 16 and 17 are marked with indicia 34 and 35, respectively, distributed preferably every 1 centimeter.

The edges 18, 19, 20, and 21 define an arrow, a bent arrow, a half arrow, and a curved arrowhead, respectively. The edge 22 defines a small circle. The edges 23 and 24 define a 90-degree curve and are marked by indicia 40.

Finally, indicia 41 are inscribed along the edge 25 of the template 11. As shown in FIG. 1, the indicia 41 are arranged to display metric dimensions.

Operation—FIG. 1

The manner of using the template for drawing plasmid DNA is similar to that of other drafting instruments for geometrical shapes, but with some important differences. Namely, the user first describes a large circle defined by the edge 13. The circle acts as the backbone of the plasmid DNA. Curved arrows or curved bars defined by the edges 14 and 15 are then traced over the large circle. Indicia 32 or 33 and 36 or 37, respectively, in cooperation with the drawn large circle allows the user to readily create a curved arrow or curved bar of a predetermined radial distance that is aligned on top of the drawn large circle. Drawing of arrows of opposite direction is facilitated by simply turning the template over. The curved arrows or curved bars represent plasmid-borne genes or other nucleic acid regulatory or structural sequences.

Similarly, straight arrows or straight bars defined by the edges 16 and 17 can be traced over a straight line. Indicia 34 or 35 and 38 or 39, respectively, in cooperation with a drawn straight line enables a user to readily draw a straight arrow or straight bar of a predetermined length that is aligned on top of the drawn straight line. The straight arrows or straight bars are linear representations of embedded genes or other nucleic acid regulatory or structural sequences.

The edges 18, 19, 20, and 21 are used to draw various forms of arrows or arrowheads in the manifestation of the plasmid DNA diagram to serve as indicators of gene transcription, replication, primer position, and other relevant markers. The edge 20 is used to trace a small circle for the depiction of additional plasmid traits.

The edge 25 in cooperation with indicia 41 serves as a straightedge for drawing lines of a desired length.

Finally, the edges 23 and 24, in cooperation with indicia 40, allows the user to create right-angled lines. This is used to help display augmentations, such as inserted DNA, to the backbone of the plasmid DNA drawing.

Conclusion, Ramifications, and Scope

In conclusion, a novel template has been disclosed and described in which a clear, plastic template bears a combination of inscribed marks and apertures adapted to cooperate with each other so as to enable a user to readily draw two-dimensional depictions of plasmid DNA. The result is a simple drafting tool.

Furthermore, the drawing template for plasmid DNA has the additional advantages in that it can be used with a variety of writing implements and surfaces. For example, the template can facilitate the drawing of plasmid DNA with a felt marker onto plastic transparencies for use in overhead projections.

While the above description contains many specificities, these should not be construed as limitations on the scope of the invention, it is merely representative of the principals of the invention and it is anticipated and expected that those skilled in the art will readily recognize and utilize other embodiments falling within the scope of the invention.

Accordingly, the scope of the invention should be determined not by the embodiment illustrated, but by the appended claims and their legal equivalents.

I claim:

1. A template for drawing circular depictions of plasmid DNA comprising, a flat plate, said plate having apertures, said apertures including a circle and at least one curved arrow, said circle having a circumferential edge, said circumferential edge being provided with a plurality of indicia evenly spaced by degrees around said circumferential edge, said curved arrow having a circular arcuate edge, said circular arcuate edge being provided with a plurality of indicia thereon, said indicia being evenly spaced around said circular arcuate edge by the identical said degrees around said circumferential edge.

2. The template of claim 1 wherein, said indicia are spaced in degrees equally around each of said circumferential edge and said circular arcuate edge.

3. The template of claim 1 wherein each said indicia is spaced 18° apart.

4. The template of claim 1 wherein, said curved arrow includes a second circular arcuate edge of different circumference.

5. The template of claim 4 wherein, said second circular arcuate edge being provided with a plurality of second indicia.

6. The template of claim 5 wherein, said second indicia are each spaced around said second circular arcuate edge by said degrees around said circumferential edge.

7. The template of claim 6 wherein, each said second indicia is spaced 18° apart.

8. The template of claim 1 wherein, said circular arcuate edge and said second circular arcuate edge are concentric.

9. The template of claim 1 wherein, said template includes a second curved arrow having a plurality of second curved arrow circular arcuate edges.

10. The template of claim 9 wherein, said second curved arrow circular arcuate edges are each provided with a plurality of indicia, said indicia being spaced thereon by the identical said degrees around said circumferential edge.

11. The template of claim 10 wherein, said plurality of second curved arrow circular arcuate edges are concentric.

12. The template of claim 10 wherein said indicia on said second curved arrow circular arcuate edges are each equally spaced in degrees.

* * * * *

UNITED STATES PATENT AND TRADEMARK OFFICE

CERTIFICATE OF CORRECTION

PATENT NO. : 6,460,267 B1
DATED : October 8, 2002
INVENTOR(S) : Robert S. Cormack It is certified that error appears in the above-identified patent and that said Letters Patent is hereby corrected as shown below:

Column 4,
Line 14, delete "1" and insert "4" in lieu thereof so claim 8 reads as follows:
-- 8. The template of claim 4 wherein,
said circular arcuate edge and said second circular arcuate edge are concentric. --

Signed and Sealed this

Twenty-fourth Day of June, 2003

JAMES E. ROGAN
*Director of the United States Patent and Trademark Office*